US005152677A

United States Patent [19]

Bauer et al.

[11] Patent Number: 5,152,677

[45] Date of Patent: Oct. 6, 1992

[54] DRY-RUNNING RECIPROCATING COMPRESSOR

[75] Inventors: Heinz Bauer, Munich; Franz Mayr, Emmering, both of Fed. Rep. of Germany

[73] Assignee: Bauer Kompressoren GmbH, Munich, Fed. Rep. of Germany

[21] Appl. No.: 687,022

[22] Filed: Apr. 18, 1991

[30] Foreign Application Priority Data

Apr. 18, 1990 [DE] Fed. Rep. of Germany ..... 4012376

[51] Int. Cl.[5] ..... F04B 39/06

[52] U.S. Cl. ..... 417/366; 417/439

[58] Field of Search ..... 417/273, 266, 366, 439

[56] References Cited

U.S. PATENT DOCUMENTS

| | | | |
|---|---|---|---|
| 4,645,428 | 2/1987 | Arregui | 417/273 |
| 4,793,779 | 12/1988 | Schabert | 417/516 |
| 4,818,192 | 4/1989 | Korthaus | 417/372 |
| 5,033,940 | 7/1991 | Baumann | 417/273 |

*Primary Examiner*—Richard A. Bertsch
*Assistant Examiner*—Peter Korytnyk
*Attorney, Agent, or Firm*—Sixbey, Friedman, Leedom & Ferguson

[57] ABSTRACT

A dry-running reciprocating compressor which has a drive mechanism with a crankcase, in which at least one crankshaft is mounted to rotate in bearings. The drive mechanism is operatively connected with at least one piston-cylinder arrangement of the compressor to compress air to the desired compression pressure. The intake air to be compressed is used for interior cooling of the drive mechanism, and for this purpose, the intake air is conducted through a filter into the interior of the crankcase. For specific cooling of especially critical parts and areas of the components and units in the interior of the crankcase, additional air conducting devices, such as air baffles, fins or the like can be provided. Preferably, the reciprocating compressor has three stages.

15 Claims, 1 Drawing Sheet

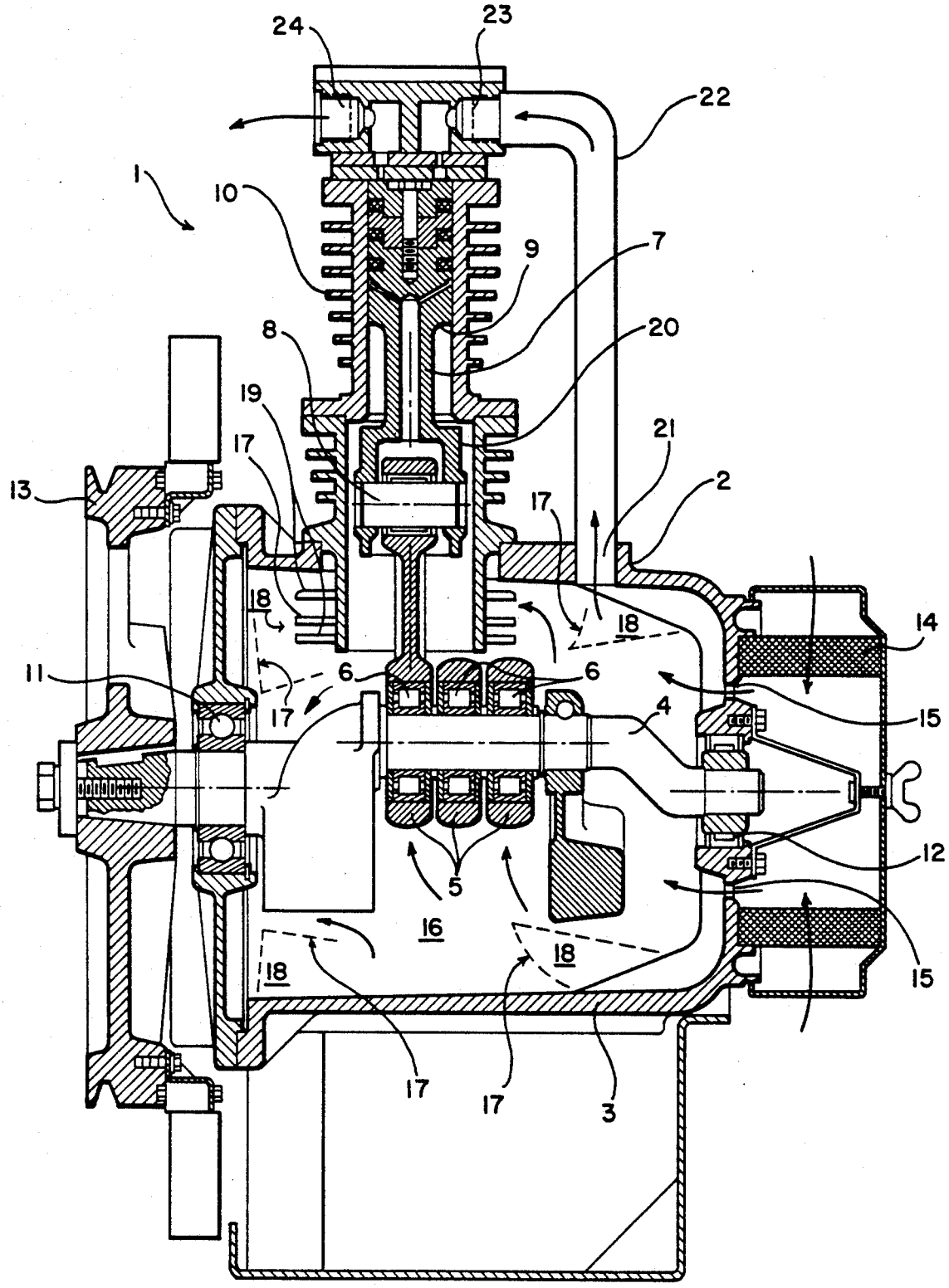
24
23
22
1
10
9
7
8
20
19
21
17
2
13
17
18
18
14
11
6
6
17
4
15
12
5
16
18
18
15
17
17
3

DRY-RUNNING RECIPROCATING COMPRESSOR

BACKGROUND OF THE INVENTION

The invention relates to a dry-running reciprocating compressor, i.e., an oiless reciprocating compressor, which has a drive mechanism with a crankcase in which a crankshaft is mounted to rotate within bearings. This drive mechanism is operatively connected to at least one piston-cylinder arrangement of the compressor.

There are basically two designs in reciprocating compressors. One design, the lubricated design, uses oil or another lubricant, which in the form of a constant-circulation lubrication is also used, among others, for cooling highly stressed parts of the compressor. The second design, to which this invention relates, is the so-called dry-running design of a compressor, in which no liquid, such as oil or the like, is available for cooling purposes. With dry-running reciprocating compressors it has been shown that the highly stressed parts of the compressor tend to rapid wear and therefore regular maintenance work has to be performed on such a compressor

SUMMARY OF THE INVENTION

The primary object of this invention is, by overcoming the above-described difficulties, to provide a dry-running reciprocating compressor of the above-mentioned type, which works effectively with an increased service life and with maintenance intervals that are as long as possible.

According to the invention, a dry-running reciprocating compressor with a drive mechanism with a crankcase in which a crankshaft is mounted to rotate within bearings, and in which the driving mechanism is operatively connected with at least one piston-cylinder arrangement of the compressor is improved by the intake air to be compressed is used for air cooling of the driving mechanism by being passed through the crankcase.

That is, in the dry-running reciprocating compressor according to the invention, the air to be compressed, which is sucked in from the environment, is used for cooling the highly stressed parts, especially such driving mechanisms as crankshaft bearings and the like. The cooling in this case takes place by combined heat transfer, heat transport and circulation of the intake air, especially in the interior of the crankcase of the drive mechanism. By this design, without additional units, an effective cooling of the highly stressed parts can be achieved so that their tendency to wear is reduced and an increased service life of such a compressor results. Also, the intervals between maintenance can be extended in comparison with present units of this type, so that a dry-running reciprocating compressor unit more favorable in regard to maintenance is obtained, which can be operated economically and in the long term with the least possible operating costs. Further, as a side effect, it is thus achieved that the air introduced in the piston-cylinder arrangement for compression is already preheated by the heat absorption in the driving mechanism, so that more favorable working conditions for the compression process in the compressor or the compressor unit are obtained.

Preferably, a filter is provided on the crankcase, namely on one of its faces, especially in the vicinity of the air intake area, so that, for example, dust or other contaminating particles in the intake air do not lead to troubles in the working of the driving mechanism.

To cool, in preferred way, especially critical and highly stressed or highly sensitive parts of the drive mechanism, air conducting devices can be placed in the crankcase between the air intake and air outlet on the crankcase, so that, for example, bearings of the crankshaft can be specifically cooled with a correspondingly guided air current. The air conducting device in this case can be designed as air baffles, or the air conducting devices can be provided in the form of fins by which increased heat transfer surfaces are made available, to achieve a more favorable heat transport to the correspondingly critical spots of the drive mechanism. At the same time, these fins can also be used as cooling air conducting devices and are correspondingly configured.

Preferably, the intake air current is at least partially specifically guided to the piston pin bearings, which are especially highly stressed parts of the drive mechanism.

Additionally or alternatively, the intake air current can also be specifically directed to the piston interiors for cooling them, so that also a piston interior cooling without an additional coolant is obtained in such dry-running reciprocating compressors by the simplest possible design.

The reciprocating compressor of the type according to the invention can comprise several compressor stages to achieve desired compression pressures, and preferably, the reciprocating compressor comprises at least three stages, i.e., at least three piston-cylinder arrangements coupled to one another by appropriate connecting pipes.

The invention is explained in greater detail below by a preferred embodiment with reference to the accompanying drawing.

BRIEF DESCRIPTION OF THE DRAWING

The sole Figure of the drawing diagrammatically shows a longitudinal section through an embodiment of a dry-running reciprocating compressor.

BRIEF DESCRIPTION OF THE DRAWING

In the sole Figure, a dry-running reciprocating compressor unit is designated, generally by the numeral 1. Compressor unit 1 has a drive mechanism 2 within a crankcase 3. The drive mechanism 2 includes a crankshaft, identified by 4, and connecting rods 5 that are mounted on its crankpin. The respective connecting rod bearings on crankshaft 4 are identified by 6. In the sectional representation shown in the Figure, only one connection of a connecting rod 5 with a piston 7 by a piston pin bearing 8 is shown. Piston 7 moves back and forth in a cylinder 9 for compression of the air taken in. The piston-cylinder arrangement as a unit is identified by 10.

As is seen from the number of connecting rods 5, the entire compressor unit 1 according to this embodiment comprises three piston-cylinder arrangements 10, of which only one is shown. These piston-cylinder arrangements 10 are suitably spaced circumferentially around the periphery of crankcase 3, preferably, at regular angular distances. But, the invention is not limited to this special design of a reciprocating compressor, and more or fewer piston-cylinder arrangements 10 can be provided, and the latter can also be provided in another arrangement on crankcase 3.

Crankshaft 4 is mounted to rotate in crankcase 3 within bearings 11, 12. On the left side in the Figure, for example, a drive pulley 13 is shown, which is permanently connected to crankshaft 4, and which is driven in rotation by a drive motor, such as an electric motor (not shown). An air filter 14 is shown on the face of the opposite side of the crankcase 3, i.e., that located on the right in the Figure. Openings or slots are identified by 15, which are provided in crankcase 3 around crankshaft bearing 12, and by which air can enter into the interior 16 of crankcase 3 after passing through air filter 14. The air filtered by air filter 14, in the interior 16 of case 3, is used for cooling of the driving mechanism 2.

Air conducting devices 17 can be provided in the interior of crankcase 3 for specifically guiding the air to especially critical areas, such as bearings 11, 12, piston pin bearing 8 and the like. These air conducting devices 17 can be formed by appropriately shaped air baffles 18 or fins 19 which are especially intended for specific cooling of piston pin bearings 8. With the fins 19, the heat transfer and heat removal from piston pin bearings 8 is intensified, and in addition, the cooling air current, in focused form, is directed to this area provided with fins 19. Also, with these fins 19, a specific cooling of the interiors 20 of pistons 7 can be achieved.

Of course, air conducting devices 17 and/or air baffles 18 and/or fins 19 are not limited in their configuration and arrangement to the details of the preferred embodiment represented. Rather, the configuration can be such that the respective desired critical areas in the interior of crankcase 3 are, preferably, automatically cooled with the air that has been taken in. The air entering by openings 15 into interior 16 of crankcase 3, after cooling the desired areas of driving mechanism 2, leaves crankcase 3 by an outlet 21 and, then, is conducted by a pipe 22 to intake side 23 of piston-cylinder arrangement 10. After compression by piston-cylinder arrangement 10, the air thus compressed then leaves by outlet side 24 and optionally, can then be guided to another piston-cylinder arrangement (not shown), which represents the next compressor stage.

As indicated by arrows, reciprocating compressor unit 1 according to the invention is provided and designed so that the ambient air to be compressed is used for cooling the components and units placed in the interior of crankcase 3 to increase their service life and to obtain especially extended intervals between maintenance for the reciprocating compressor unit 1. This cooling with the air to be compressed can be achieved without great design costs and permits an exceptionally efficient cooling of driving mechanism 2. As a result, a reciprocating compressor 1 is obtained, which can be reliably operated for long periods and relatively maintenance free, so that a compressor unit 1 that can be operated economically can be provided.

Of course, the invention is not limited to the details represented but many changes and modifications are possible, which one skilled in the art will make if necessary, without leaving the scope of the invention. Especially additional and other air conducting devices 17 can optionally be arranged, whose design and arrangement depends especially on the design of reciprocating compressor 1, which in turn can depend on the field of use. Thus, the invention should be viewed as encompassing the full scope of the appended claims.

We claim:

1. Dry-running reciprocating compressor with a drive mechanism with a crankcase in which at least one crankshaft is mounted to rotate within bearings, the drive mechanism being operatively connected with at least one piston-cylinder arrangement of the compressor, wherein an air intake for air to be compressed is provided in the crankcase as a means for interior cooling of drive mechanism by said air before compressing thereof by the piston-cylinder arrangement; and wherein a filter is provided on the crankcase at the air intake.

2. Dry-running reciprocating compressor according to above claim 1 wherein the reciprocating compressor comprises plural stages.

3. Dry-running reciprocating compressor according to claim 2, wherein the reciprocating compressor comprises three (3) stages.

4. Dry-running compressor according to claim 1 wherein, for specific cooling of the bearings of the crankshaft air conducting devices are provided in the crankcase between the air intake and an air outlet to the at least one piston-cylinder unit.

5. Dry-running compressor according to claim 4, wherein the air conducting devices comprise air baffles.

6. Dry-running compressor according to claim 4, wherein air conducting devices comprise fins.

7. Dry-running compressor according to claim 4, wherein the air conducting devices direct an intake air current to piston pin bearings.

8. Dry-running compressor according to above claim 7, wherein the air conducting devices also direct the intake air current to piston interior sides for cooling them.

9. Dry-running compressor according to above claim 4, wherein the air conducting devices direct an intake air current to piston interior sides for cooling them.

10. Dry-running reciprocating compressor with a drive mechanism with a crankcase in which at least one crankshaft is mounted to rotate within bearings, the drive mechanism being operatively connected with at least one piston-cylinder arrangement of the compressor, wherein an air intake for air to be compressed is provided in the crankcase as a means for interior cooling of drive mechanism by said air before compressing thereof by the piston-cylinder arrangement; and wherein, for specific cooling of the bearings of the crankshaft, air conducting devices are provided in the crankcase between the air intake and an air outlet to the at least one piston-cylinder unit.

11. Dry-running reciprocating compressor according to claim 10, wherein the air conducting devices comprise air baffles.

12. Dry-running reciprocating compressor according to claim 10, wherein air conducting devices comprise fins.

13. Dry-running reciprocating compressor according to claim 10, wherein the air conducting devices direct an intake air current to piston pin bearings.

14. Dry-running reciprocating compressor according to claim 13, wherein the air conducting devices also direct the intake air current to piston interior sides for cooling them.

15. Dry-running reciprocating compressor according to claim 10, wherein the air conducting devices direct an intake air current to piston interior sides for cooling them.

* * * * *